US007878274B2

(12) United States Patent
Buske et al.

(10) Patent No.: US 7,878,274 B2
(45) **Date of Patent: *Feb. 1, 2011**

(54) STEEL TOOTH DISK WITH HARDFACING

(75) Inventors: Robert J. Buske, The Woodlands, TX (US); James L. Overstreet, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 138 days.

This patent is subject to a terminal disclaimer.

(21) Appl. No.: 12/239,025

(22) Filed: Sep. 26, 2008

(65) Prior Publication Data

US 2010/0078225 A1 Apr. 1, 2010

(51) Int. Cl.
*E21B 10/46* (2006.01)
*E21B 10/16* (2006.01)

(52) U.S. Cl. ..... 175/374; 175/378; 175/425

(58) Field of Classification Search ..... 175/374, 175/375, 425, 378

See application file for complete search history.

(56) References Cited

U.S. PATENT DOCUMENTS

| | | | | |
|---|---|---|---|---|
| 2,527,838 | A | 10/1950 | Morlan et al. | |
| 2,339,684 | A | 6/1960 | Payne | |
| 4,752,916 | A | 6/1988 | Loewenthal | |
| 5,351,769 | A | 10/1994 | Scott | |
| 5,445,231 | A | 8/1995 | Scott et al. | |
| 5,586,082 | A | 12/1996 | Anderson et al. | |
| 5,831,934 | A | 11/1998 | Gill et al. | |
| 5,899,958 | A | 5/1999 | Dowell et al. | |
| 5,995,447 | A | 11/1999 | Mandal et al. | |
| 6,206,115 | B1 | 3/2001 | Overstreet | |
| 6,374,704 | B1 | 4/2002 | Scott et al. | |
| 6,766,870 | B2 | 7/2004 | Overstreet | |
| 6,782,958 | B2 | 8/2004 | Liang | |
| 7,035,165 | B2 | 4/2006 | Tang | |
| 7,240,746 | B2 | 7/2007 | Overstreet et al. | |
| 7,343,990 | B2 | 3/2008 | Pessier | |
| 7,346,454 | B2 | 3/2008 | Mathieu et al. | |
| 7,492,664 | B2 | 2/2009 | Tang et al. | |
| 2010/0078226 | A1 * | 4/2010 | Buske et al. | 175/374 |
| 2010/0078227 | A1 * | 4/2010 | Buske et al. | 175/374 |

FOREIGN PATENT DOCUMENTS

| | | |
|---|---|---|
| WO | 9859264 | 12/1998 |

OTHER PUBLICATIONS

Ilya Tsvankin, Normal Moveout From Dipping Reflectors In Anisotropic Media, Geophysics, vol. 60, No. 1, Jan.-Feb. 1995, p. 268-284.

Yibing Zheng, et al., Imaging Near-Borehole Structure Using Acoustic Logging Data With Pre-Stack F-K Migration, 4 pages, date unknown.

(Continued)

*Primary Examiner*—Giovanna C Wright
(74) *Attorney, Agent, or Firm*—Bracewell & Giuliani LLP

(57) ABSTRACT

An earth boring drill bit comprising a milled cutter having rows of teeth hardfacing guides on the cutter. Hardfacing is applied between adjacent teeth hardfacing guides to form a cutting element. The hardfacing may extend past the crest of the teeth hardfacing guides or end along the teeth hardfacing guides flanks.

19 Claims, 3 Drawing Sheets

OTHER PUBLICATIONS http://segdl.aip.org/vsearch/servlet/VerityServlet?pgID=abs_wrap &prog=searchid=GPY, Synthetic Full-Waveform Acoustic Logs in Cased Boreholes, II,Poorly Bonded Casing, Kenneth M. Tubman et al., Jun. 14, 2006, 2 pages.

Chung Chang, et al., Localized Maps of the Subsurface, Oilfield Review, p. 56-66, 1998.

http://www.elsevier.com/wps/find/bookdescription.print/699894/ descrption, Quantitative Borehold Acoustic Methods, 24, X.M. Tang et al. Jun. 14, 2006, 2 pages.

Brian E. Hornby, Imaging of Near-Borehole Structure Using Full-Waveform Sonic Data, Geophysics vol. 54, No. 6, Jun. 1989, 13 pages.

B. Joyce et al, Introduction of a New Omni-Directional Acoustic System for Improved Real-Time LWD Sonic Logging-Tool Design and Field Test Results, 14 pages, 2001.

Cengiz Esmersoy, et al. Acoustic Imaging of Reservoir Structure From a Horizontal Well, The Leading Edge, vol. 17, Issue 7, Jul. 1998, p. 940-946.

Y.Li et al., Single-Well Imaging With Acoustic Reflection Survey at Mounds, Oklahoma, USA EAGE 64th Confernce & Exhibition—Florence, Italy May 27-30, 2002, 4 pages.

Tang, Section 4.2.3.1 Wave Separation, Permeability Estimation—Chapter 4, Quantitative Borehole Acoustic Methods, 2 Pages, 2004.

Xiaoming Tang, Imaging Near-Borehole Structure Using Directional Acoustic-Wave Measurement, Geophysics, vol. 69, No. 6, Nov.-Dec. 2004, p. 1378-1386.

Xiao Tang, Predictive Processing of Array Acoustic Waveform Data, Geophysics, vol. 62, No. 6, Nov.-Dec. 1997, p. 1710-1714.

* cited by examiner

STEEL TOOTH DISK WITH HARDFACING

BACKGROUND

1. Field of Invention

The disclosure herein relates in general to rolling cone earth boring bits, and in particular to improving the performance of a steel tooth bit.

2. Description of Prior Art

Drilling systems having earth boring drill bits are used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation.

Drill bits typically are chosen from one of two types, either drag bits or roller cone bits. Rotating the bit body with the cutting elements on the outer surface of the roller cone body crushes the rock and the cuttings may be washed away with drilling fluid. One example of a roller cone bit 11 is provided in a side partial perspective view in FIG. 1, the bit 11 having a body 13 with a threaded attachment 15 on the bit 11 upper end for connection to a drill string (not shown). The bit 11 further includes legs 18 extending downward from the bit body 13. Each bit leg 18 is shown having a lubricant compensator 17.

The bit body 13 is further illustrating having a nozzle 19 for directing pressurized drilling fluid from within the drill string to cool and lubricate bit 11 during drilling operation. A plurality of cutters 21 are rotatably secured to respective bit legs 18. Typically, each bit 11 has three cutters 21, and one of the three cutters is obscured from view in FIG. 1.

Each cutter 21 has a shell surface including a gauge surface 25 and a heel region indicated generally at 27. Teeth 29 are formed in heel region 27 and form a heel row 28 of teeth. The heel teeth 29 depicted are of generally conventional design, each having leading and trailing flanks 31 which converge to a crest 33. Each tooth 29 has an inner end (not shown) and an outer end 35 that join to crest 33.

Typically steel tooth bits are for penetration into relatively soft geological formations of the earth. The strength and fracture toughness of the steel teeth permits the use of relatively long teeth, which enables the aggressive gouging and scraping actions that are advantageous for rapid penetration of soft formations with low compressive strengths. However, geological formations often comprise streaks of hard, abrasive materials that a steel-tooth bit should penetrate economically without damage to the bit. Although steel teeth possess good strength, abrasion resistance is inadequate to permit continued rapid penetration of hard or abrasive streaks. Consequently, it has been common in the arts since at least the 1930s to provide a layer of wear-resistance metallurgical material called "hardfacing" over those portions of the teeth exposed to the severest wear. The hardfacing typically consists of extremely hard particles, such as sintered, cast, or macrocrystalline tungsten carbide, dispersed in a steel matrix.

Typical hardfacing deposits are welded over a steel tooth that has been machined similar to the desired final shape. Generally, the hardfacing materials do not have a tendency to heat crack during service which helps counteract the occurrence of frictional heat cracks associated with carbide inserts. The hardfacing is much harder than the steel tooth material, therefore the hardfacing on the surface of steel teeth makes the teeth more resistant to wear.

A front view of a cutter 21 is illustrated in FIG. 2. Shown formed on the cutter 21 is an inner row 36 having inner row teeth 37 extending radially inward from the heel 27. The inner row teeth 37 have flanks 31 and crests 33 similar to those of the heel teeth 29. An apex 38 is shown proximate to the cutter 21 center, the apex 38 having grooves 39 radially extending from the apex 38 midpoint to its outer periphery. The cutter 21 further includes scrapers 41 on the heel row 28 between the base of adjacent teeth 29. A layer of hardfacing 35 is shown having been applied to surfaces of the heel teeth 29 and the inner row teeth 37.

SUMMARY OF INVENTION

Disclosed herein is an earth boring drill bit comprising, a milled cutter having rows of teeth hardfacing guides on the cutter. Hardfacing is applied between adjacent teeth hardfacing guides to form a cutting element. The hardfacing may extend past the crest of the teeth hardfacing guides or end along the teeth hardfacing guides flanks. In one embodiment, an earth boring bit includes a body, a leg depending from the body, a bearing shaft extending radially inward from the leg, a cutter mounted on the bearing shaft, the cutter having a row of cutting teeth hardfacing guides, the teeth hardfacing guides having a base and flanks extending from the base and joining to form a crest, and hardfacing extending from a first flank onto an oppositely facing second flank, wherein the first flank and second flank are disposed on adjacently disposed teeth hardfacing guides.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
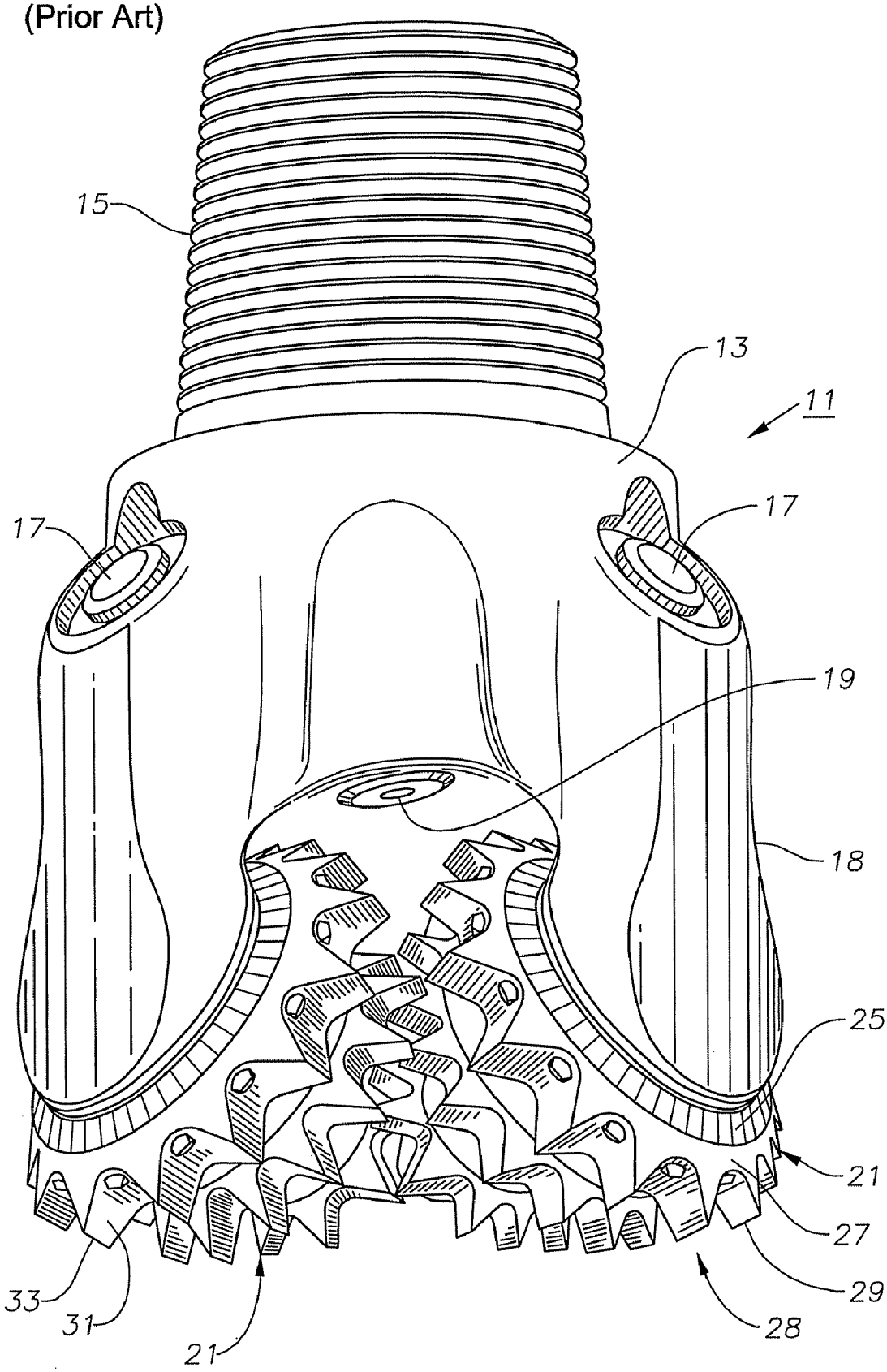
Fig. 1 (Prior Art)
FIG. 1 is a side perspective view of a prior art roller cone bit.
Figure 2:
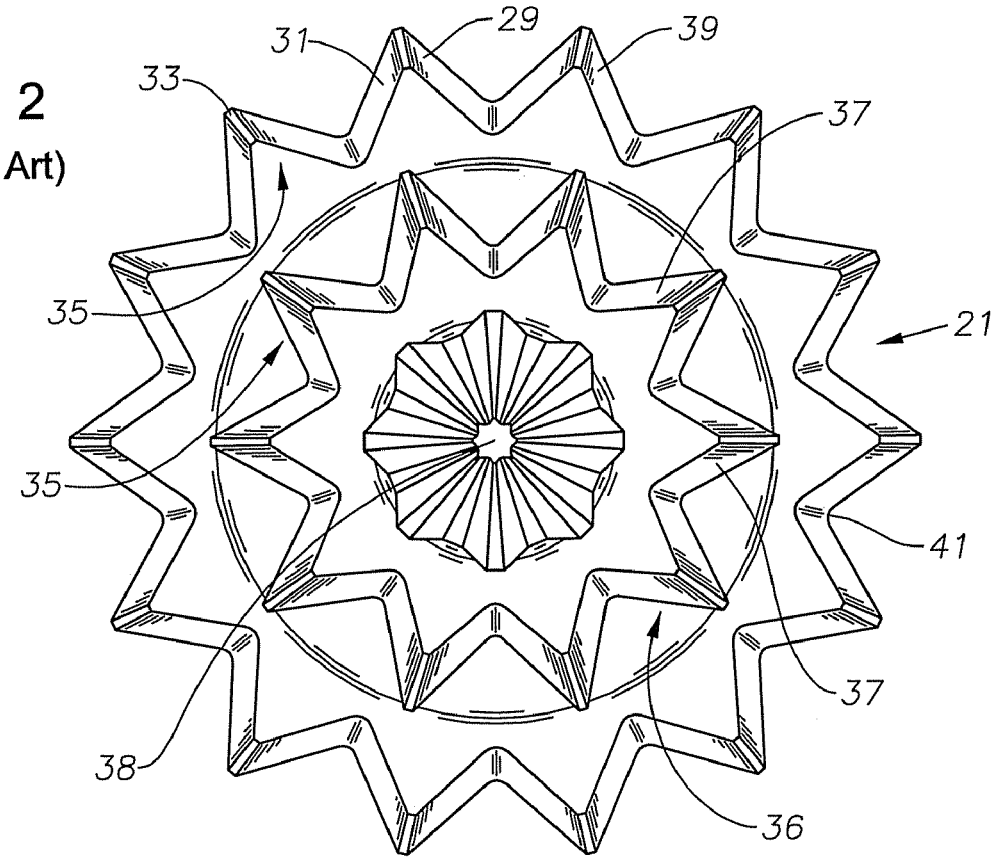
Fig. 2 (Prior Art)
FIG. 2 depicts a front view of a prior art milled steel tooth cutter.
Figure 3A:
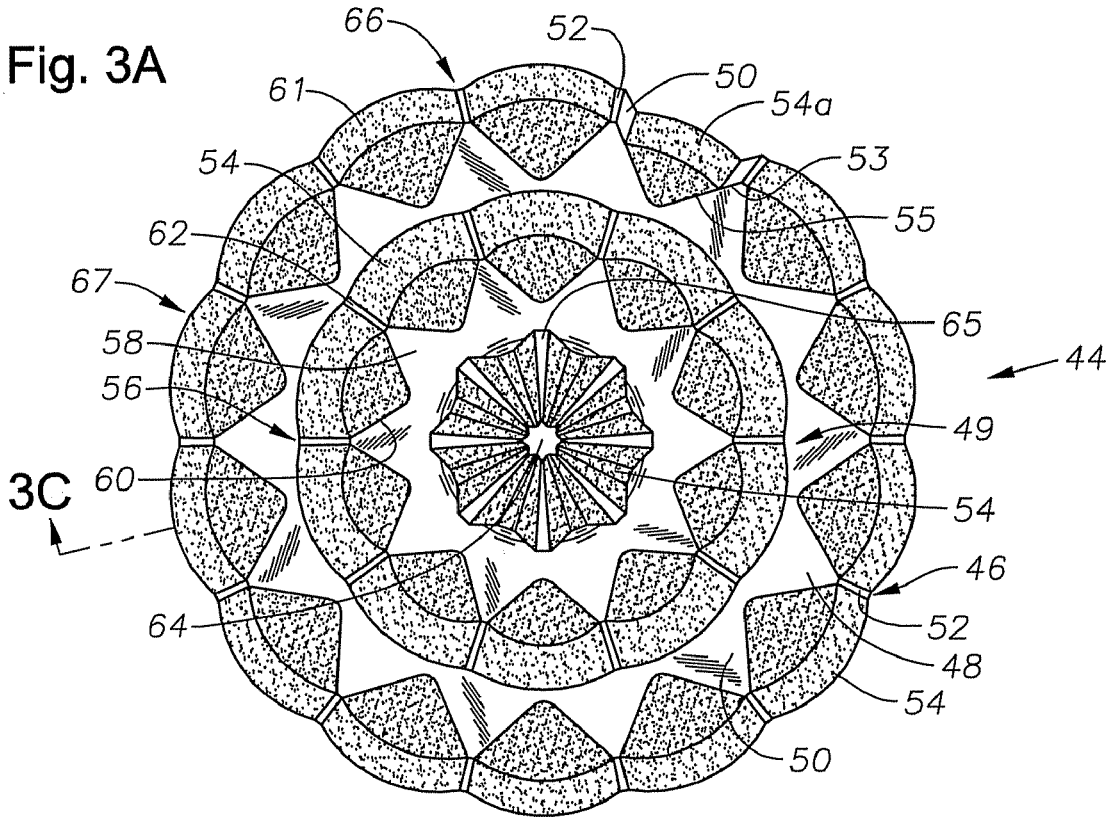
FIGS. 3*a* and 3*b* illustrate a front view of a cutter in accordance with the present disclosure.
Figure 3B:
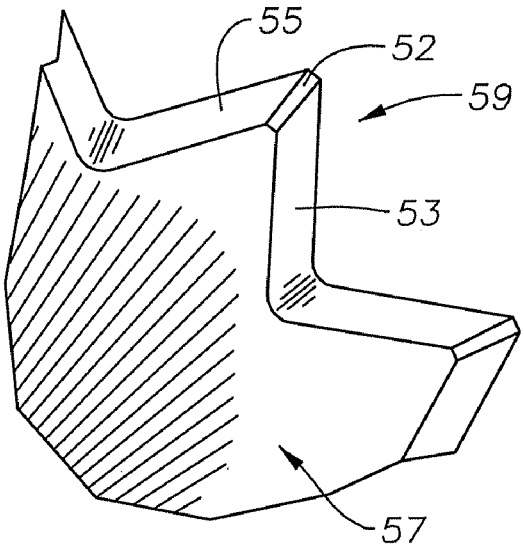

With reference now to FIG. 3*a* an example of a roller cone with cutter 44 in accordance with the present disclosure is illustrated in a front view. The cutter 44 comprises heel teeth hardfacing guides 48 arranged on its outer periphery forming a heel row 46. The heel teeth hardfacing guides 48 are defined by flanks 50 on opposing sides of the teeth hardfacing guides 48. The flanks 50, which comprise leading 53 and trailing 55 flanks, are inwardly angled upward from a base 49 and join to form a crest 52. In FIG. 3*b*, an example of a portion of the heel row, 46 is depicted in perspective view illustrating an inner side 57 and an outer side 59.

Hardfacing 54 has been added to the gap between oppositely facing flanks 50 of adjacently disposed teeth hardfacing guides 48. The hardfacing 54 is affixed to the flanks 50 and comprises a cutting structure for use in earth boring operations when implementing the cutter 44 with an earth boring bit. In one example of use, the teeth hardfacing guides 48 comprise steel, which is softer than hardfacing, thus wearing quicker during boring operations. As the steel teeth hardfacing guides 48 wear down, the hardfacing 54 remains affixed between adjacently disposed teeth hardfacing guides 48 to continue providing a cutting surface. As the hardfacing 54 wears, the circumferential cutting contact length decreases to improve drilling. The upper surface 61 of the hardfacing 54 can optionally form a generally sharp crest 67 which can have roughly the same thickness as crests 52 of the teeth hardfacing guides 48. Also, the hardfacing crest 67 has a generally curved contour from tooth hardfacing guides to tooth hardfacing guides. The curved contour preferably bulges out leaving a valley 66 between the crests. The hardfacing 54 can be flush with one or both of the inner side 57 or outer side 59. Similarly, hardfacing 54 can be flush or bulge outward on the inner row 56 sides.

The cutter 44 of FIG. 3*a* also includes an inner row of teeth hardfacing guides 58 forming an inner row 56 concentric within the heel row 46. The inner row of teeth hardfacing guides 58 also include flanks 60 angled inward to form a crest 62 at the outward end of the teeth hardfacing guides 58. Hardfacing 54 may optionally be included within the gaps existing between the oppositely facing flanks 60 on adjacently disposed teeth hardfacing guides 58. The cutter 44 also optionally includes an apex 64 provided on its upper surface, the apex 64 can have teeth hardfacing guides 65 thereon forming a grooved or profiled upper surface and include hardfacing 54 thereon.

Embodiments exist where hardfacing 54 is applied only between teeth hardfacing guides 48 of the heel row 46 or optionally only between teeth hardfacing guides 58 of the inner row 56 or rows not shown. The amount of hardfacing 54 can also vary. The hardfacing 54 can extend outward from the gap past the crests 52 of adjacently disposed teeth hardfacing guides 48, 58. Optionally, hardfacing 54*a* can be added having a terminal upper surface remaining within the gap.

Figure 3C:
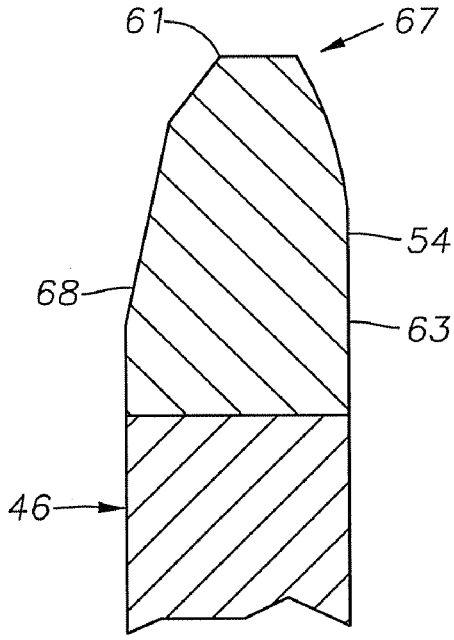
FIG. 3*c* is a cross sectional view of a portion of the cutter of FIG. 3*a*.

FIG. 3*c* is a cross sectional view of a portion of an embodiment of the cutter 44 of FIG. 3*a*. Hardfacing 54 is shown extending away from the trough of a heel row 46 with a generally planar front surface 63 and a rear surface 68 contoured toward the front surface 63 so at the hardfacing upper edge 61 the crest 67 width is smaller than the heel row 46 width.

Figure 4:
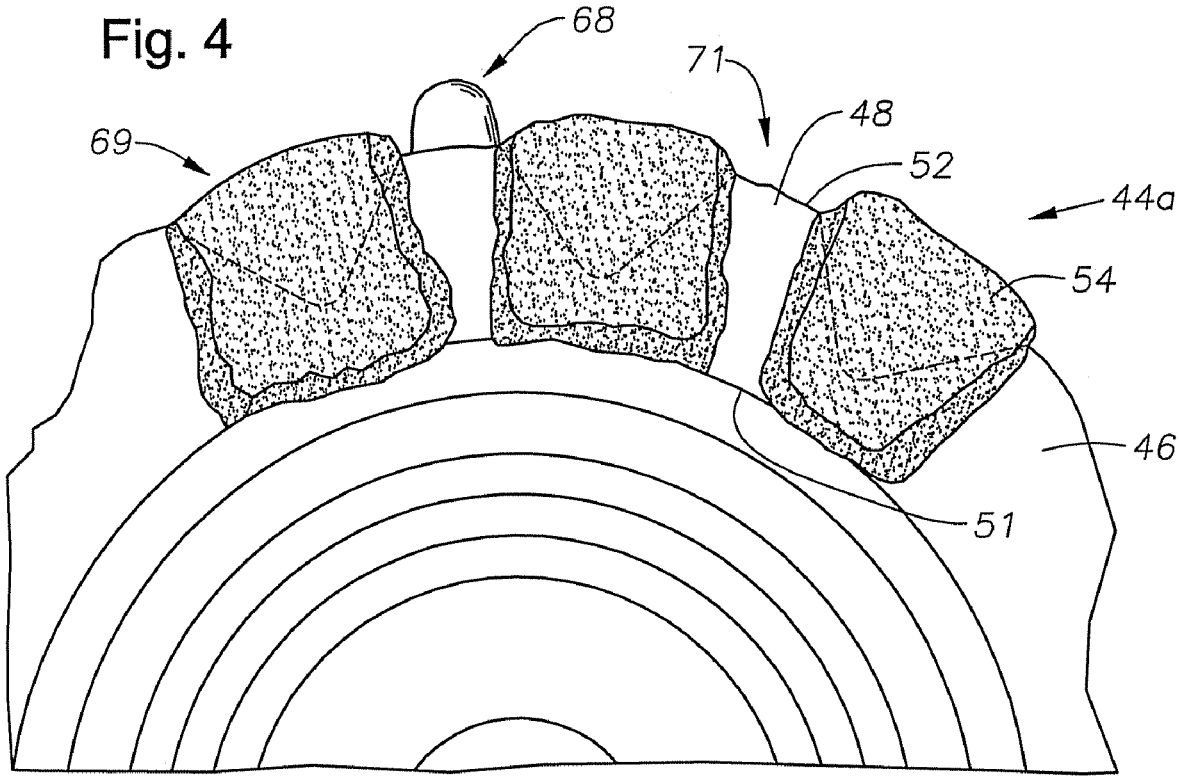
FIG. 4 illustrates a rear view of a cutter in accordance with the present disclosure.

FIG. 4 depicts a rearward view of an embodiment of a cutter 44*a* having webs 69 of hardfacing 54 spanning between adjacent heel teeth hardfacing guides 48 formed on the roller cone with cutter 44*a*. In this view the hardfacing 54 extends downward below the crest 52 of the heel teeth hardfacing guides 48 and terminating at a cutter hub 51. Spaces 71 are shown between adjacent webs 69, however the hardfacing 54 can comprise a single member over the teeth hardfacing guides. Although hardfacing 54 is not shown on the gauge surface in this embodiment, hardfacing 54 can be applied to the gauge surface.

It is to be understood that the invention is not limited to the exact details of construction, operation, exact materials, or embodiments shown and described, as modifications and equivalents will be apparent to one skilled in the art. For example, the scope of this disclosure includes roller cones having more than two rows of cutting elements on a roller cone land. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

We claim:

1. An earth boring bit comprising:

a body;

a leg depending from the body;

a bearing shaft extending radially inward from the leg;

a cutter mounted on the bearing shaft, the cutter having a row of teeth hardfacing guides, the teeth hardfacing guides having a base and flanks extending from the base and joining to form a crest; and hardfacing spanning between opposing flanks of adjacently disposed teeth hardfacing guides, the hardfacing forming a web between the adjacently disposed teeth hardfacing guides to be primary cutting elements.

2. The earth boring bit of claim 1, wherein the row of cutting teeth hardfacing guides comprise a heel row disposed on the cutter outer periphery.

3. The earth boring bit of claim 1, wherein the row of cutting teeth hardfacing guides comprises an inner row disposed on the cutter.

4. The earth boring bit of claim 1, wherein the hardfacing extends above the crests of the adjacently disposed teeth hardfacing guides.

5. The earth boring bit of claim 1, wherein the hardfacing upper surface is below the crests of the adjacently disposed teeth hardfacing guides.

6. The earth boring bit of claim 1, wherein the hardfacing comprises an earth boring cutting surface on its upper periphery.

7. The earth boring bit of claim 1 further comprising an apex portion affixed to the cutter mid section, cutting teeth hardfacing guides on the apex, and hardfacing applied between adjacent teeth hardfacing guides on the apex.

8. The earth boring bit of claim 1, the row having an inner side and an outer side, the hardfacing forming pads on the row outer side, the pads separated by recessed area.

9. An earth boring bit comprising:

a body;

a cutter rotatably mounted on the body;

a row of teeth hardfacing guides around the cutter integrally formed with the cutter and having leading and trailing flanks; and cutting members comprising hardfacing, having a generally arcuate upper edge, and formed along at least a portion of the leading and trailing flanks and extending between oppositely facing of adjacently disposed teeth hardfacing guides.

10. The cutter of claim 9 wherein the row of teeth hardfacing guides is arranged on a heel portion of the cutter body.

11. The cutter of claim 10 further comprising an inner row of teeth hardfacing guides arranged in a curved line on the cutter body concentrically disposed within the row of teeth hardfacing guides on the heel portion.

12. The cutter of claim 11 further comprising cutting members attached between the oppositely facing sides of adjacently disposed teeth hardfacing guides, within the inner row, the cutting members comprising hardfacing.

13. The cutter of claim 9 wherein the row of teeth hardfacing guides comprise an inner row.

14. The cutter of claim 13 further comprising a heel row of teeth hardfacing guides arranged in a curved line on the cutter body periphery concentrically disposed around the inner row.

15. The cutter of claim 14 further comprising cutting members attached between the oppositely facing sides of adjacently disposed teeth hardfacing guides within the heel row, the cutting members comprising hardfacing.

16. The cutter of claim 14 wherein the row of teeth hardfacing guides is arranged on a heel portion of the cutter body.

17. An earth boring bit comprising:

a body;

a leg depending from the body;

a hearing shaft extending radially inward from the leg;

a cutter mounted on the bearing shaft, the cutter having a row of teeth hardfacing guides, the teeth hardfacing guides having a base and flanks extending from the base and joining to form a crest, wherein the row of teeth hardfacing guides comprise a heel row disposed on the cutter outer periphery and an inner row concentric within the heel row; and hardfacing along a portion of each flank and spanning between opposing flanks of adjacently disposed teeth hardfacing guides forming a web between the adjacently disposed teeth hardfacing guides.

18. The cutter of claim 17 wherein the row of teeth hardfacing guides is arranged on a heel portion of the cutter body.

19. The earth boring bit of claim 17, wherein the hardfacing web upper surface is curved between adjacent teeth hardfacing guides.

* * * * *